United States Patent [19]

Hosoda et al.

[11] Patent Number: 4,993,393

[45] Date of Patent: Feb. 19, 1991

[54] AIR-FUEL RATIO FEEDBACK CONTROL METHOD FOR INTERNAL COMBUSTION ENGINES

[75] Inventors: Fumio Hosoda; Sachito Fujimoto; Hiroshi Ono; Katsushi Watanabe, all of Wako, Japan

[73] Assignee: Honda Giken Kogyo K.K., Tokyo, Japan

[21] Appl. No.: 559,907

[22] Filed: Jul. 30, 1990

[30] Foreign Application Priority Data

Aug. 7, 1989 [JP] Japan ..... 1-204387

[51] Int. Cl.[5] ..... F02D 41/14

[52] U.S. Cl. ..... 123/489; 123/440

[58] Field of Search ..... 123/440, 489, 492

[56] References Cited

U.S. PATENT DOCUMENTS 4,137,877 2/1979 Saito ..... 123/440
4,401,086 8/1983 Miyagi ..... 123/440 X
4,411,236 10/1983 Matsui et al. ..... 123/440 X
4,461,258 7/1984 Becker et al. ..... 123/440
4,739,740 4/1988 Ohkawara et al. ..... 123/440 X

FOREIGN PATENT DOCUMENTS 246432 10/1988 Japan .

*Primary Examiner*—Tony M. Argenbright
*Attorney, Agent, or Firm*—Arthur L. Lessler

[57] ABSTRACT

A method of controlling air-fuel ratio of a mixture supplied to an internal combustion engine in a feedback manner responsive to an output signal from an exhaust gas concentration sensor. The air-fuel ratio of the mixture is controlled to a desired value by means of proportional control and integral control. The proportional control is inhibited, when the value of the output signal has changed from a lean side to a rich side with respect to a predetermined reference value while the engine is operating in one of a predetermined high load condition and a predetermined high rotational speed condition.

7 Claims, 10 Drawing Sheets

FUEL INJECTION VALVE
6
INTERNAL COMBUSTION ENGINE
1
2
3
3'
4
θTH
PBA
7
8
TA
9
Tw
10
Ne
11
13
THREE-WAY CATALYST
14
O2
15
VH
16
PA
17
5
5a
5b
5c
5d
INPUT CIRCUIT
C P U
MEMORY MEANS
OUTPUT CIRCUIT
ECU

| FIG. 2A | FIG. 2B |
|---|---|

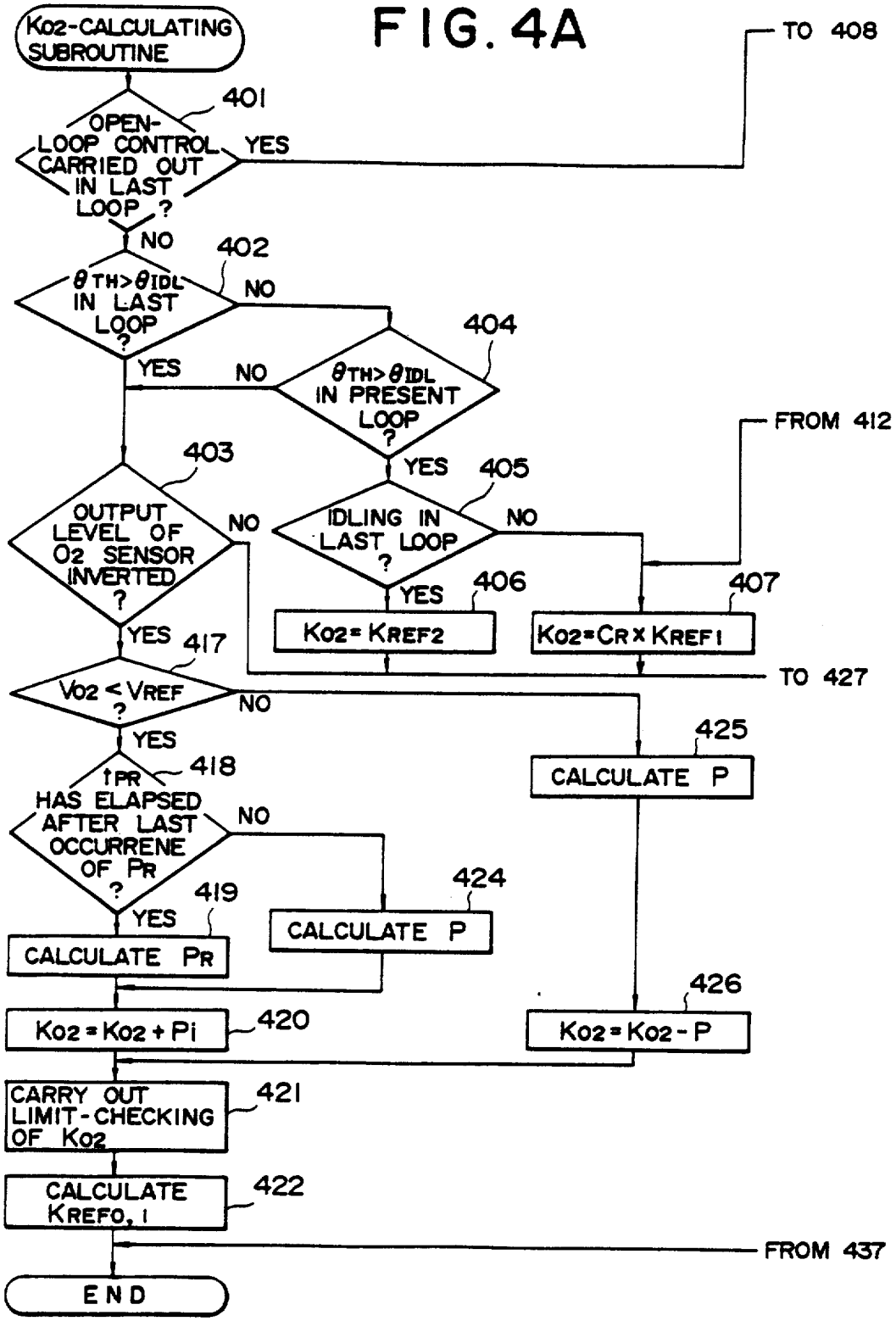
FIG. 4A
KO2-CALCULATING SUBROUTINE
401
OPEN-LOOP CONTROL CARRIED OUT IN LAST LOOP ?
YES
TO 408
NO
402
θTH>θIDL IN LAST LOOP ?
NO
YES
404
θTH>θIDL IN PRESENT LOOP ?
NO
YES
FROM 412
403
OUTPUT LEVEL OF O2 SENSOR INVERTED ?
NO
405
IDLING IN LAST LOOP ?
NO
YES
406
KO2=KREF2
407
KO2=CR×KREF1
TO 427
YES
417
VO2<VREF ?
NO
YES
425
CALCULATE P
418
tPR
HAS ELAPSED AFTER LAST OCCURRENE OF PR ?
NO
YES
419
CALCULATE PR
424
CALCULATE P
KO2=KO2+Pi
420
426
KO2=KO2-P
CARRY OUT LIMIT-CHECKING OF KO2
421
CALCULATE KREFO, I
422
FROM 437
END FROM 401
408
Ko2 HELD IN LAST LOOP ?
YES
NO
409
IDLING ?
YES
NO
410
θTH>θIDL IN LAST LOOP ?
NO
YES
TO 407
412
θTH>θIDL IN PRESENT LOOP ?
YES
NO
413
Tw>Twcl ?
YES
NO
411
Ko2 = KREF1
415
Ko2 = KREF0
416
HOLD Ko2
Ko2=CL x KREF0
414
FROM 403, 406, 407
427
Vo2<VREF ?
NO
YES
428
NIL = NIL + 1
433
NIH = NIH + 1
429
NIL = NI ?
NO
YES
434
NIH = NI ?
NO
YES
430
Ko2 = Ko2 + ΔKR
435
Ko2 = Ko2 - ΔKL
431
NIL = 0
NIH = 0
432
HOLD Ko2
436
CALCULATE KREF2
437
TO END

AIR-FUEL RATIO FEEDBACK CONTROL METHOD FOR INTERNAL COMBUSTION ENGINES

BACKGROUND OF THE INVENTION

This invention relates to an air-fuel ratio feedback control method for internal combustion engines, and more particularly to a method of this kind which is applied when the engine is operating in a high load or high speed condition.

An air-fuel ratio feedback control method is conventionally known, in which the amount of fuel supplied to the engine is increased by the use of an incremental proportional term when the output from an exhaust gas concentration sensor arranged in the exhaust system of the engine changes from a rich side to a lean side with respect to a predetermined reference value, whereas the amount of fuel is decreased by the use of a decremental proportional term when the output from the sensor changes from the lean side to the rich side.

An improvement in such a method has been proposed by the present assignee in Japanese Provisional Patent Publication (Kokai) No. 63-246432 in which when the engine has continued to operate under a steady heavy load condition over a predetermined time period, the incremental proportional term is set to a larger value in order to reduce the amount of NOx emitted under such a steady heavy load operating condition of the engine such as high speed cruising.

According to the above manner proposed by the present assignee of further enriching the air-fuel ratio, the amount of change in the air-fuel ratio in the enriching direction temporarily increases when the incremental proportional term thus set to a larger value is applied, and then gradually increases due to application of an incremental integral term. However, thereafter, when the output from the exhaust gas concentration sensor has changed from the lean side to the rich side with respect to the predetermined reference value, &he amount of change in the air-fuel ratio in the leaning direction temporarily increases due to application of the decremental proportional term, and then gradually increases due to application of a decremental integral term. Therefore, the resulting average air-fuel ratio cannot be shifted by a large amount in the enriching direction i.e to an air-fuel ratio much richer than the stoichiometric air-fuel ratio (A/F=14.7), at which the best conversion efficiency of the exhaust gas-purifying device is obtained. As a result the combustion temperature of the engine is so high as to cause deterioration of the catalyst of the exhaust gas-purifying device.

In order to eliminate this inconvenience, one will try to set the incremental proportional term to a still larger value to thereby increase the amount of change in the air-fuel ratio in the enriching direction. As a result, however, the amount of change in the fuel supply largely increases when the output from the exhaust gas concentration sensor has changed from the rich side to the lean side, which results in an increased amount of change in the output torque of the engine and hence degraded driveability of the vehicle.

SUMMARY OF THE INVENTION

It is the object of the invention to provide an air-fuel ratio feedback control method which is capable of more properly carrying out air-fuel ratio feedback control when the the engine is operating in a high load or high speed condition, and preventing deterioration of &he catalyst of an exhaust gaspurifying device, without degrading the driveability of the vehicle.

To attain the above object, the present invention provides a method of con&rolling the air-fuel ratio of a mixture supplied to an internal combustion engine in a feedback manner responsive to an output signal from an exhaust gas concentration sensor for detecting the concentration of a component in exhaust gas from the engine, the method including the steps of:

comparing the value of the output signal with a predetermined reference value; and controlling the air-fuel ratio of the mixture to a desired value by means of proportional control applying a first correction value to correct the air-fuel ratio when the value of the output signal has changed from a rich side to a lean side or vice versa with respect to the predetermined reference value, and integral control applying a second correction value to correct the air-fuel ratio whenever a predetermined period of time elapses so long as the value of the output signal remains on the lean side or on the rich side with respect to the predetermined reference value.

The method according to the invention is characterized by comprising the step of:

inhibiting the correction by the first correction value, when the value of the output signal has changed from the lean side to the rich side with respect to the predetermined reference value while the engine is operating in one of a predetermined high load condition and a predetermined high rotational speed condition.

Preferably, the first correction value is set to a relatively small value as compared with when the engine is not operating in the predetermined high rotational speed condition, when the value of the output signal has changed from the rich side to the lean side with respect to the predetermined reference value while the engine is operating in the predetermined high rotational speed condition.

Also preferably, the second correction value is set to a smaller value when the engine is operating in the predetermined high rotational speed condition than when the condition of the engine is not operating in the predetermined high rotational speed condition.

Preferably, the first correction value is increased as the rotational speed of the engine increases, when the value of the output signal has changed from the lean side to the rich side with respect to the predetermined reference value while the engine is not operating in the predetermined high rotational speed condition.

Preferably, the second correction value is increased as the rotational speed of the engine increases, when the engine is nor operating in the predetermined high rotational speed condition.

Also preferably, the first correction value is set based on the rotational speed of the engine and the intake pipe absolute pressure of the engine, when the value of the output signal has changed from the rich side to the lean side with respect to the predetermined reference value while the engine is not operating in the predetermined high rotational speed condition.

Preferably, the predetermined reference value is set based on the rotational speed of the engine and atmosperic pressure.

The above and other objects, features, and advantages of the invention will be more apparent from the ensuing detailed description taken in conjunction with the accompanying drawings.

DETAILED DESCRIPTION

The method according to an embodiment of the invention will now be described in detail with reference to the drawings.

Figure 1:
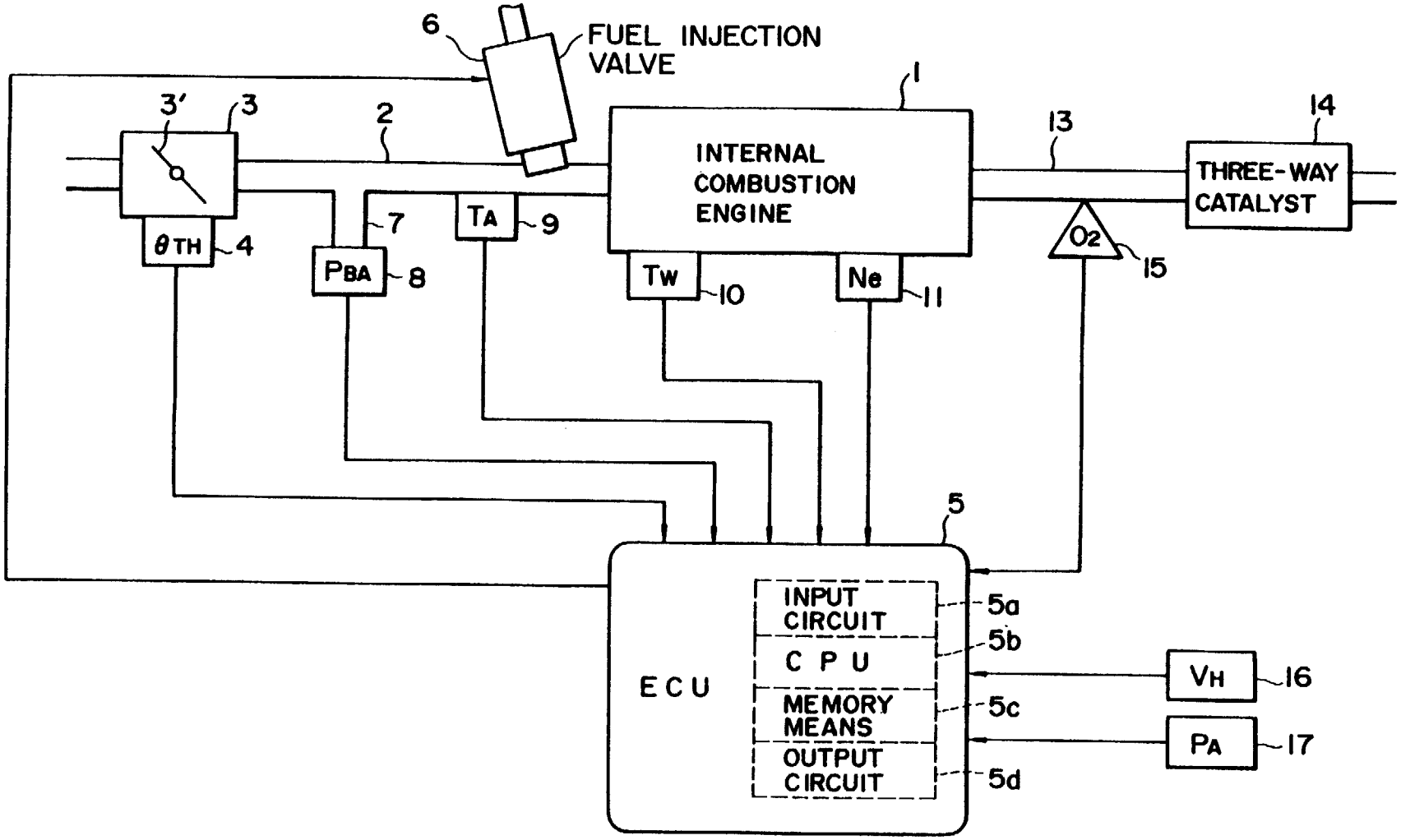
FIG. 1 is a schematic diagram showing the whole arrangement of a fuel supply control system for an internal combustion engine to which is applied the method according to the present invention.

Referring first to FIG. 1, there is shown the whole arrangement of a fuel supply control system for an internal combustion engine 1 to which is applied the method according to the invention. Connected to the cylinder block of the engine 1 is an intake pipe 2 across which is arranged a throttle body 3 accommodating a throttle valve 3' therein. A throttle valve opening ($\theta_{TH}$) sensor 4 is connected to the throttle valve 3' for generating an electric signal indicative of the sensed throttle valve opening and supplying same to an electronic control unit (hereinafter referred to as "the ECU") 5.

Fuel injection valves 6, only one of which is shown, are inserted into the intake pipe at locations intermediate between the cylinder block of the engine 1 and the throttle valve 3' and slightly upstream of respective intake valves, not shown. The fuel injection valves 6 are connected to a fuel pump, not shown, and electrically connected to the ECU 5 to have their valve opening periods controlled by signals therefrom.

On the other hand, an intake pipe absolute pressure ($P_{BA}$) sensor 8 is provided in communication with the interior of the intake pipe 2 at a location immediately downstream of the throttle valve 3' by way of a conduit 7 for supplying an electric signal indicative of the sensed absolute pressure within the intake pipe 2 to the ECU 5. An intake air temperature ($T_A$) sensor 9 is inserted into the intake pipe 2 at a location downstream of the open end of the conduit 7 for supplying an electric signal indicative of the sensed intake air temperature $T_A$ to the ECU 5.

An engine coolant temperature ($T_W$) sensor 10, which may be formed of a thermistor or the like, is mounted in the cylinder block of the engine 1, for supplying an electric signal indicative of the sensed engine coolant temperature $T_W$ to the ECU 5. An engine rotational speed (Ne) sensor 11 is arranged in facing relation to a camshaft, not shown, or a crankshaft, not shown, of the engine 1. The engine rotational speed sensor 11 generates a pulse as a TDC signal pulse at each of predetermined crank angles whenever the crankshaft rotates through 180 degrees, the pulse being supplied to the ECU 5.

A three-way catalyst 14 is arranged within an exhaust pipe 13 connected to the cylinder block of the engine 1 for purifying noxious components such as HC, CO, and NOx. An $O_2$ sensor 15 as an exhaust gas concentration sensor is mounted in the exhaust pipe 13 at a location ups&ream of the three-way catalyst 14, for sensing the concentration of oxygen present in exhaust gases emitted from the engine 1 and supplying an electric signal indicative of the sensed oxygen concentration to the ECU 5.

Further electrically connected to the ECU 5 are a vehicle speed ($V_H$) sensor 16 for detecting the speed of the vehicle, and an atmospheric pressure ($P_A$) sensor 17 for detecting atmospheric pressure. Signals from these sensors are supplied to the ECU 5.

The ECU 5 comprises an input circuit 5*a* having the functions of shaping the waveforms of input signals from various sensors, shifting the voltage levels of sensor output signals to a predetermined level, converting analog signals from analog-output sensors to digital signals, and so forth a central processing unit (hereinafter called "the CPU") 5*b*, memory means 5*c* storing various operational programs which are executed in the CPU 5*b* and for storing results of calculations therefrom, etc., and an output circuit 5*d* which outputs driving signals to the fuel injection valves 6.

The CPU 5*b* operates in response to the abovementioned signals from the sensors to determine, in a manner referred to hereinafter, operating conditions in which the engine 1 is operating, such as a feedback control region for controlling the air-fuel ratio in response to oxygen concentration in exhaust gases and a plurality of regions (hereinafter referred to as "open-loop control regions") in which the air-fuel ratio feedback control is not carried out, and calculates, based upon the determined operating conditions, the valve opening period or fuel injection period $T_{OUT}$ over which the fuel injection valves 6 are to be opened, by &he use of the following equation (1) in synchronism with inputting of TDC signal pulses to the ECU 5.

$$T_{OUT} = Ti \times K_{02} \times K_{LS} \times K_1 + K_2 \ldots \quad (1)$$

where Ti represents a basic fuel amount, more specifically a basic fuel injection period of the fuel injection valves 6, which is determined based upon the engine rotational speed Ne and the intake pipe absolute pressure $P_{BA}$.

$K_{02}$ is an $O_2$ feedback correction coefficient (hereinafter simply referred to as "the correction coefficient", whose value is determined in the feedback control region, in response to oxygen concentration in the exhaust gases, e.g. in a manner shown in FIG. 4, whereas, in any of the open-loop control regions, it is determined depending on each operating condition of the engine 1, in a manner shown in FIG. 2.

$K_{LS}$ is a leaning coefficient which is set to a predetermined value (e.g. 0.95) smaller than 1.0 when the operating condition of the engine is in a predetermined decelerating region. i.e. a leaning region in which the air-fuel ratio is leaned or a fuel cut region in which fuel supply is cut off, both of which belong to the open-loop control regions.

$K_1$ and $K_2$ represent other correction coefficients and correction variables, respectively, which are calculated based on various engine parameter signals to such values as to optimize operating characteristics of the engine such as fuel consumption and accelerability, depending on operating conditions of the engine.

The CPU 5b supplies the fuel injection valves 6 with driving signals for opening same by way of the circuit 5d, based on the fuel injection period $T_{OUT}$ obtained as above.

Figure 2A:
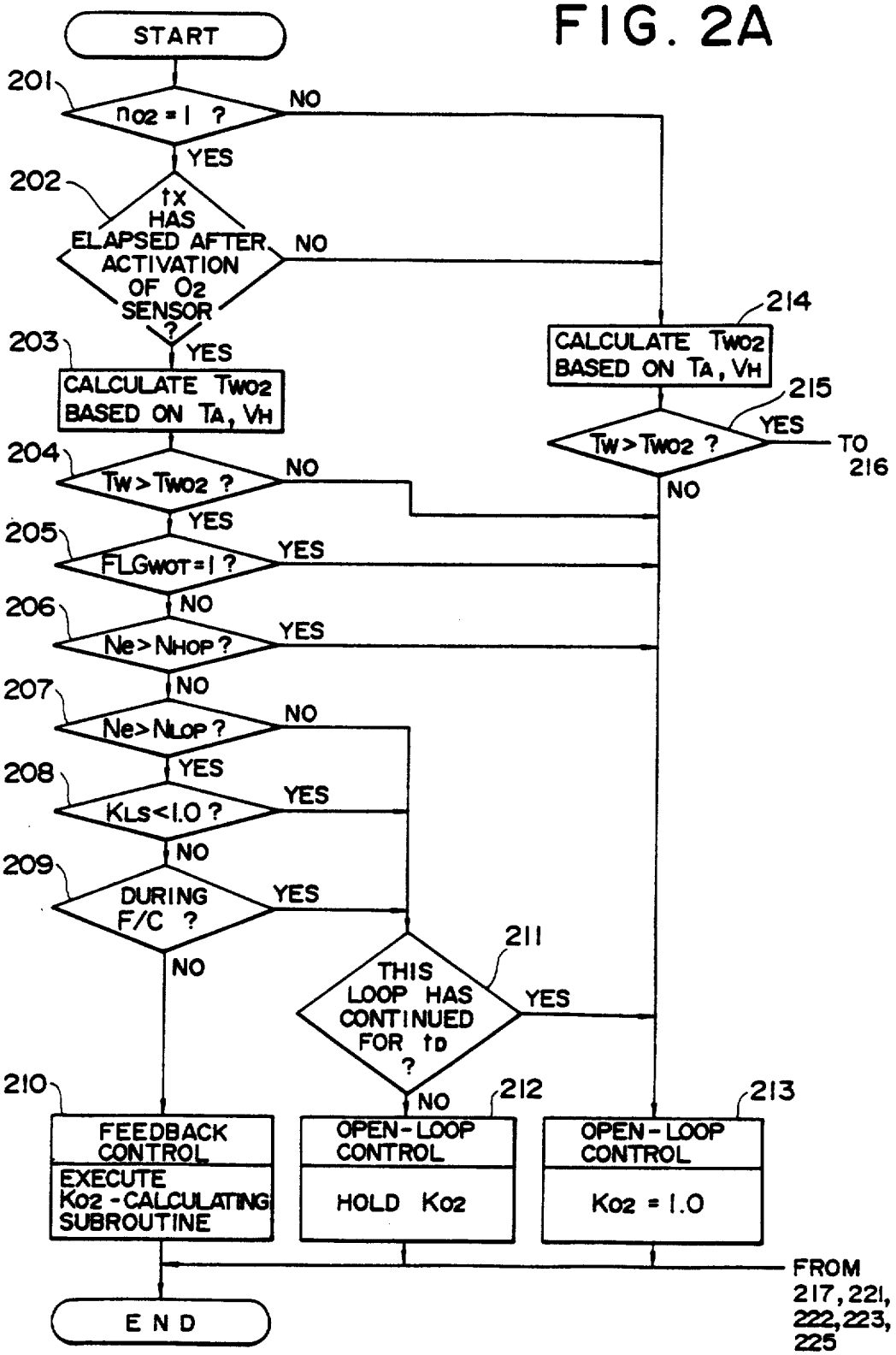
FIG. 2, 2A and 2B are flowchart of a program for determining operating conditions of the engine and setting a correction coefficient ($K_{02}$)
Figures 2, 2B:
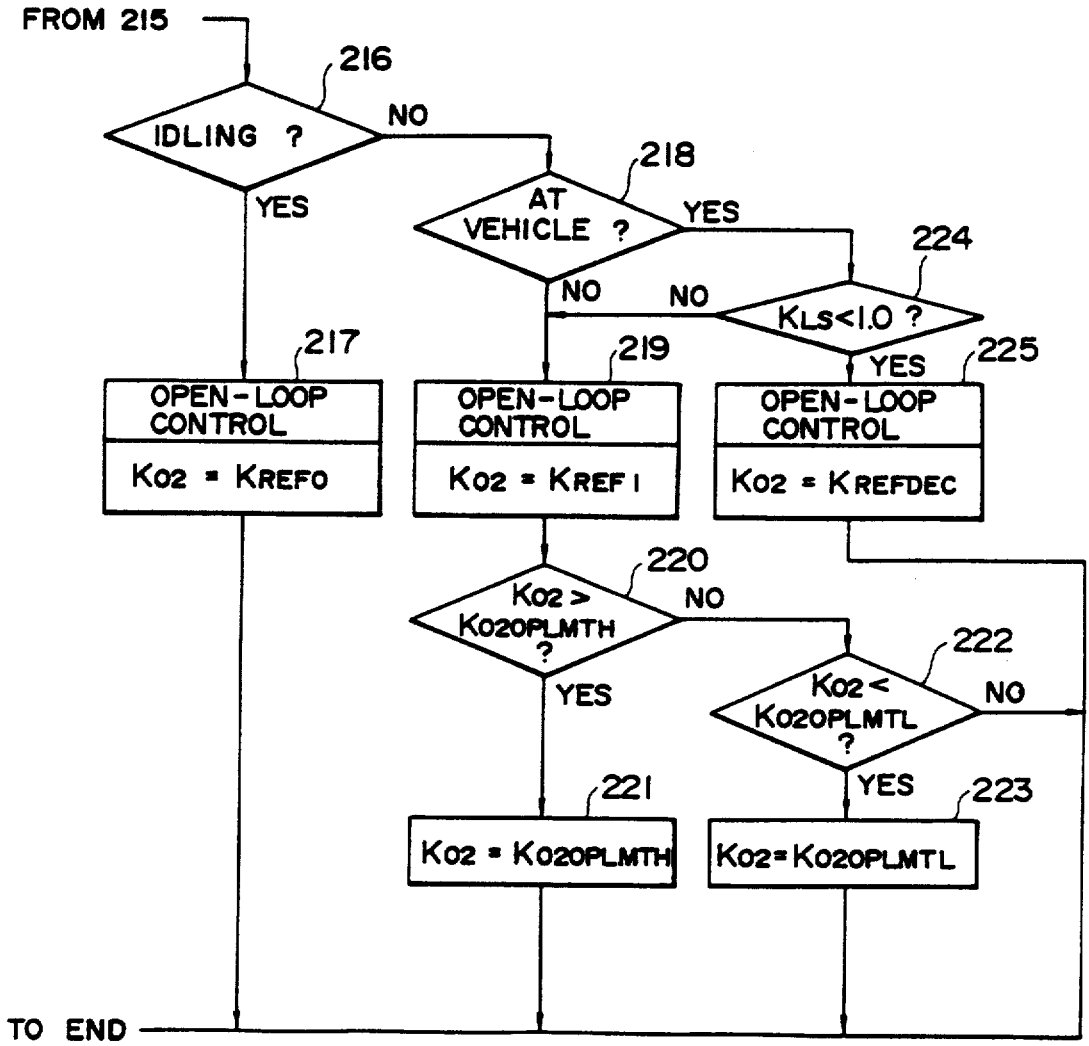

FIG. 2 shows a program for determining which of the feedback control region and the open-loop control regions the engine is in, and setting the correction coefficient $K_{02}$ in accordance with the determined region. This program is carried out upon generation of each TDC pulse and in synchronism therewith.

First at a step 201, it is determined whether or not a flag $\eta_{02}$ is equal to 1. The flag $\eta_{02}$ is for indicating whether or not the $O_2$ sensor is determined to be activated, and set to 0 when the ECU 5 is initialized and to 1 when the $O_2$ sensor is determined to be activated. If the answer to this question is affirmative (Yes) i.e. $\eta_{02}=1$, which means that the $O_2$ sensor has been determined to be activated, it is determined at a step 202 whether or not a predetermined time period $t_X$ has elapsed after the condition of $\eta_{02}=1$ was satisfied i.e. after the $O_2$ sensor 15 was activated. If the answer to this question is affirmative (Yes), a predetermined engine coolant temperature $T_{W02}$ is set in accordance with the intake air temperature $T_A$ and the vehicle speed $V_H$ at a step 203.

Figure 3:
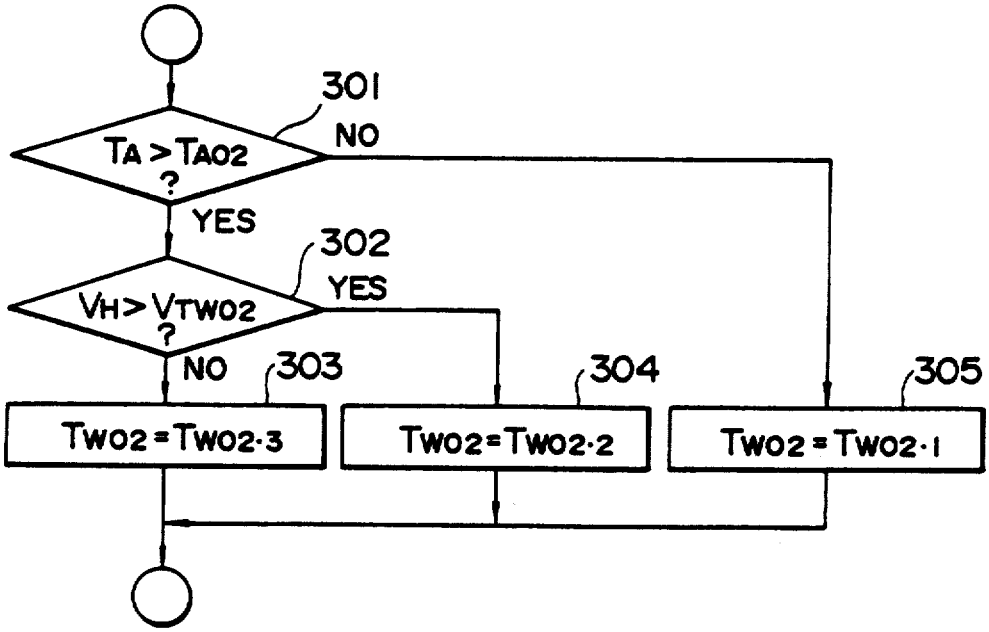
FIG. 3 is a flowchart of a subroutine for setting a predetermined engine coolant temperature ($T_{W02}$) for determining a warmed-up condition of the engine.

FIG. 3 shows a subroutine for setting the predetermined engine coolant temperature $T_{W02}$. At a step 301, it is determined whether or not the intake air temperature $T_A$ is higher than a predetermined value (e.g. 19° C. If the answer to this question is negative (No), i.e. if $T_A \leqq T_{A02}$, the predetermined engine coolant temperature $T_{W02}$ is set to a first value $T_{W02\text{-}1}$ (e.g. 80° C.) at a step 305. If the answer to the question of the step 301 is affirmative (Yes), i.e. if $T_A > T_{A02}$, it is determined at a step 302 whether or no& the vehicle speed $V_H$ is higher than a predetermined value $V_{TW02}$ (e.g. 15 km/h). If the answer to this question is affirmative (Yes), i.e. if $V_H > V_{TW02}$, the predetermined engine coolant temperature $T_{W02}$ is set to a second value $T_{W02\text{-}2}$ (e.g. 24° C.) at a step 304, whereas if the answer is negative (No) i.e. if $V_H \leqq V_{TW02}$, the predetermined coolant temperature $T_{W02}$ is set to a third value $T_{W02\text{-}3}$ (e.g. 49° C.) at a step 303.

Referring again to FIG. 2, at a step 204 it is determined whether or not the engine coolant temperature $T_W$ is higher than the predetermined engine coolant temperature $T_{W02}$ calculated as above. If the answer to this question is affirmative (Yes), i.e if $T_W > T_{WO2}$, which means the warming-up of the engine 1 has been completed, it is determined at a step 205 whether or not a flag $FLG_{WOT}$ is equal to 1. The flag $FLG_{WOT}$ is set to 1 when it is determined that the operating condition of the engine 1 is in a high load region in which the fuel supply should be increased, by a subroutine, not shown.

If the answer to the question of the step 205 is negative (No), i.e. if the engine is not in the high load region, it iS determined at a step 206 whether or not the engine rotational speed Ne is higher than a predetermined high value $N_{HOP}$. If the answer to this question is negative (No), it is further determined at a step 207 whether or not the engine rotational speed Ne is higher than a predetermined low value $N_{LOP}$. If the answer to this question is affirmative (Yes) i.e. if $N_{LOP} < Ne \leqq N_{HOP}$, it is determined at a step 208 whether or not the leaning coefficient $K_{LS}$ is smaller than 1.0, i.e. whether or not the engine 1 is in the predetermined decelerating region. If the answer to this question is negative (No). it is determined at a step 209 whether or not the fuel supply to the engine 1 is being cut off. If the answer to this question is negative (No), it is judged that the engine is in the feedback control region, and the program proceeds to a step 210, where the correction coefficient $K_{02}$ and an average value $K_{REF}$ of the correction coefficient $K_{02}$ are calculated in response to the output from the $O_2$ sensor 15 by a $K_{02}$-calculating subroutine (FIG. 4), referred to hereinafter followed by terminating the present program.

If the answer to the question of the step 207 is negative (No), i.e. if Ne≦NLOP, which means that the operating condition of the engine 1 is in a low engine rotational speed region, or if the answer to the question of the step 208 is affirmative (Yes), i.e. if the engine is in the predetermined decelerating region, or if the answer to the question of the step 209 is affirmative (Yes), i.e. if the fuel supply to the engine 1 is being cut off, the program proceeds to a step 211. At the step 211, it is determined whether or not a predetermined time period $t_D$ has elapsed after the program started to continuously proceed through this step, i.e. the step 211. If the answer to this question is negative (No), the correction coefficient $K_{02}$ is held at a value assumed immediately before the program started to continuously proceed through the step 211 (step 212), whereas if the answer is affirmative (Yes), the correction coefficient $K_{02}$ is set to 1.0 at a step 218 to thereby carry out open-loop control, followed by terminating the present program. In other words, if it is determined by the above steps 207 to 209 that the operating condition of the engine 1 has changed from the feedback control region to any of the open-loop control regions defined by the conditions of the steps 207 to 209, the correction coefficient $K_{02}$ is held at a value assumed during feedback control immediately before the change until the predetermined time period $t_D$ elapses after the change, whereas the correction coefficient $K_{02}$ is set to 1.0 after the predetermined time period $t_D$ has elapsed.

If the answer to the question of the step 204 is negative (No), i.e. if the warming-up of the engine 1 has not yet been completed or if the the answer to the question of the step 205 is affirmative (Yes), i.e. if the engine 1 is in the high load region or if the answer to the question of the step 206 is affirmative (Yes), i.e. if the engine 1 is in a high rotational speed region the program proceeds to the step 213 to carry out open-loop control followed by terminating the present program.

If the answer to the question of the step 201 is negative (No), i.e. if the $O_2$ sensor 15 has not been determined to be activated, or if the answer to the question of the step 202 is negative (No), i.e. the predetermined time period $t_X$ has not elapsed after completion of activation of the $O_2$ sensor, steps 214 and 215 are carried out in just same manner as the steps 203 and 204. If the answer to the question of the step 215 is negative (No). i.e. if the warming-up of the engine 1 has not been completed, the step 213 is carried out, followed by terminating the present program.

If the answer to the question of the step 215 is affirmative (No) , i.e. if the warming-up of the engine 1 has been completed. it is determined at a step 216 whether or not the engine 1 is in an idling region. This determination is carried out by determining whether or not the engine rotational speed Ne is lower than a predetermined value and at the same time the throttle valve opening $\theta_{TH}$ is smaller than a predetermined value. If the answer to the question of the step 216 is affirmative (Yes), i.e. if the engine 1 is in the idling region, the correction coefficient $K_{02}$ is set at a step 217 to an average value (hereinafter referred to as "the idling region average value") $K_{REFO}$ of the correction coefficient $K_{02}$ for use in the idling region, which is calculated in a manner described hereinafter, to thereby carry out open-loop control, followed by terminating the present program.

If the answer to the question of the step 216 is negative (No), i.e. if the engine is in a region (hereinafter referred to as "the off-idling region") other than the idling region, it is determined at a step 218 whether or not the vehicle in which the engine 1 is installed is an AT vehicle, i.e. a vehicle equipped with an automatic transmission. If the answer to this question is negative (No) i.e. if the vehicle is not an AT vehicle, the program proceeds to a step 219, where the correction coefficient $K_{02}$ is set to an average value (hereinafter referred to as "the off-idling region average value") $K_{REF1}$ of the correction coefficient $K_{02}$ for use in the off-idling region calculated as described hereinafter.

Then at steps 220 et seq., limit-checking of the value $K_{REF1}$ of the correction coefficient $K_{02}$ set at the step 219 is carried out. More specifically, it is determined at a step 220 whether or not the value $K_{REF1}$ of the correction coefficient $K_{02}$ is larger than an upper limit value $K_{020PLMTH}$ thereof. If the answer to this question is affirmative (Yes), the correction coefficient $K_{02}$ is reset at a step 221 to the upper limit value $K_{020PLMTH}$, whereas is the answer is negative (No), it is determined at a step 222 whether or not the value $K_{REF1}$ of the correction coefficient $K_{02}$ is smaller than a lower limit value $K_{020PLMTHL}$. If the answer to this question is affirmative (Yes), the correction coefficient $K_{02}$ is reset at a step 223 to the lower limit value $K_{020PLMTL}$, followed by terminating the present program, whereas if the answer is negative (No), the program is immediately terminated.

If the answer to the question of the step 218 is affirmative (No), i.e. if the vehicle is an AT vehicle, it is determined at a step 224 whether or not the leaning coefficient $K_{LS}$ is smaller than 1.0. If the answer to this question is negative (No), i.e. if $K_{LS} \geqq 1.0$, the steps 219 et seq. are carried out, whereas if the answer is affirmative i.e. if $K_{LS} < 1.0$, the correction coefficient $K_{02}$ is set at a step 225 to an average value $K_{REFDEC}$ of the correction coefficient $K_{02}$ calculated in the predetermined decelerating region for use therein to thereby carry out open-loop control followed by terminating the present program.

Figures 4, 4A, 4B:
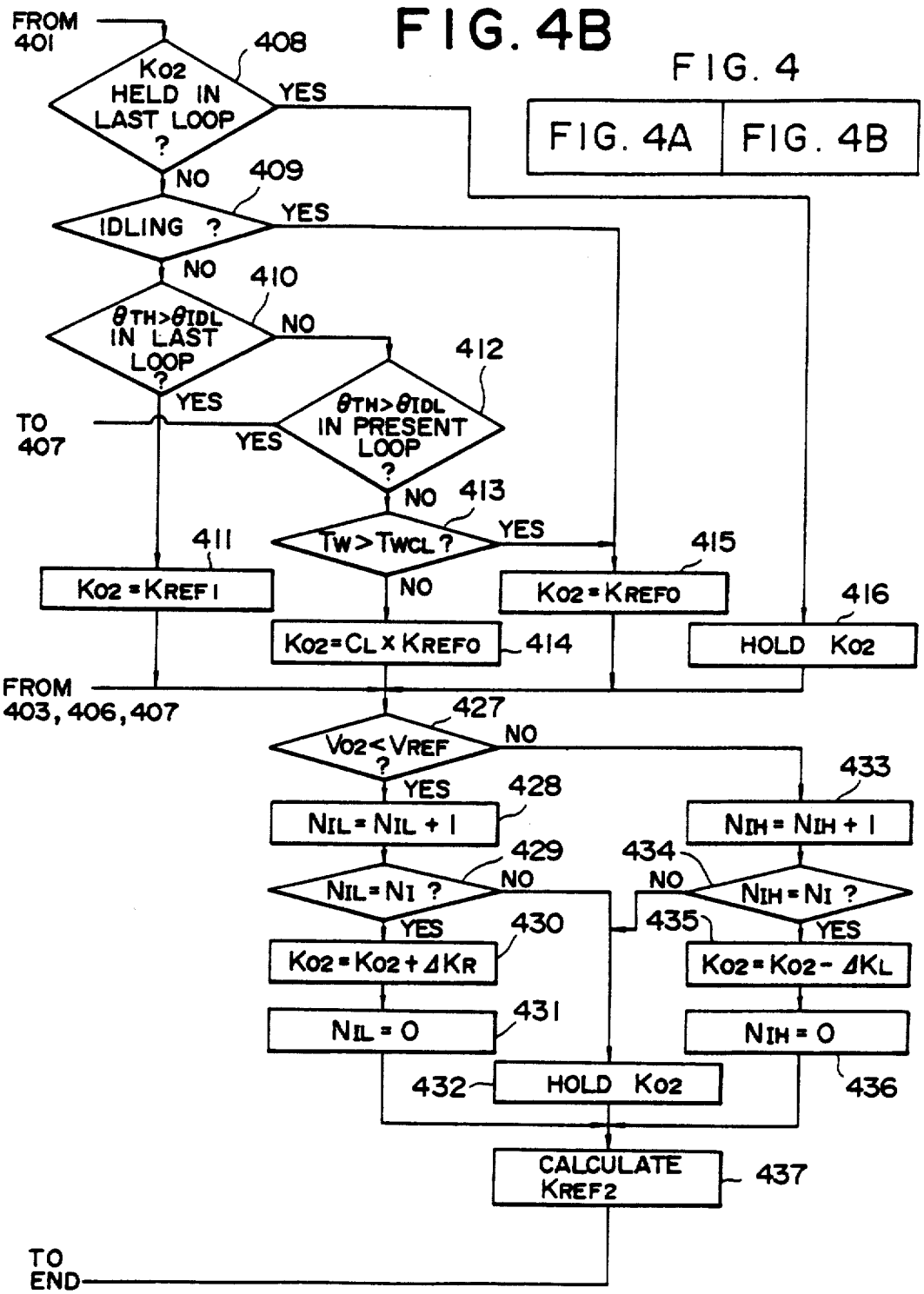
FIG. 4, 4A and 4B are a flowchart of a subroutine for calculating the correction coefficient ($K_{02}$) during air-fuel ratio feedback control of the engine.

FIG. 4 shows a subroutine for calculation of the correction coefficient $K_{02}$ carried out at the step 210 in FIG. 2 during feedback control.

First, at a step 401, it is determined whether or not open-loop control was carried out in the immediately preceding loop. If the answer to this question is affirmative (yes}, it is determined at a step 408 whether or not the holding of the value of the correction coefficient $K_{02}$ was carried out at the step 212 in FIG. 2 in the immediately preceding loop. If the answer to this question is affirmative (Yes), the holding of the value of the correction coefficient $K_{02}$ is continued at a step 416, and integral control (I-term control) is carried out by steps 427 et seq. referred to hereinafter.

If the answer to the question of the step 408 is negative (No), i.e. if the holding of the value of the correction coefficient $K_{02}$ was not carried out in the immediately preceding loop it is determined at a step 409 whether or not the engine is in the idling region. If the answer to this question is affirmative (Yes), i.e. if the engine 1 is in the idling region, the correction coefficient $K_{02}$ is set to the idling region average value $K_{REF0}$ at a step 415. and integral control is carried out at the steps 427 et seq.

If the answer to the question of the step 409 is negative (No), i.e. if the engine is in the off-idling region, it is determined at a step 410 whether or not the throttle valve opening $\theta_{TH}$ was larger than an idling throttle valve opening value $\theta_{IDL}$ (a reference value for defining the idling region) in the immediately preceding loop. If the answer to this question is affirmative (Yes), the correction coefficient $K_{02}$ is set to the off-idling region average value $K_{REF1}$ at a step 411, and integral control is carried out at the steps 427 et seq.

If the answer to the question of the step 410 is negative (No), i.e. if the condition of $\theta_{TH} \leqq \theta_{IDL}$ was satisfied in the immediately preceding loop, it is further determined at a step 412 whether or not the throttle valve opening $\theta_{TH}$ is larger than the idling throttle valve opening value $\theta_{IDL}$ in the present loop. If the answer to this question is affirmative (Yes), i.e. if $\theta_{TH} \leqq \theta_{IDL}$ in the immediately preceding loop and $\theta_{TH} > \theta_{IDL}$ in the present loop, the correction coefficient $K_{02}$ is set at a step 407 to a product $C_R \times K_{REF1}$ of the off-idling region average value $K_{REF1}$ and a predetermined enriching coefficient $C_R$, and integral control is carried out at the steps 427 et seq. In this connection, the predetermined enriching coefficient is set at a value larger than 1.0.

If the answer to the question of the step 412 is negative (No), i.e. if $\theta_{TH} \leqq \theta_{IDL}$, it is determined at a step 413 whether or not the engine coolant temperature $T_W$ is higher than a predetermined value $T_{WCL}$ (e.g. 70° C.). If the answer to this question is affirmative (Yes), i.e. if $T_W > T_{WCL}$, which means that the engine coolant temperature $T_W$ is not in a low temperature region, the program proceeds to the step 15.

If the answer to the question of the step 413 is negative (No), i.e. if $T_W \leqq T_{WCL}$, which means that the engine coolant temperature $T_W$ is in the low temperature region, the correction coefficient $K_{02}$ is set at a step 414 to a product $C_L \times K_{REF0}$ of the off-idling region average value $K_{REF0}$ and a predetermined leaning coefficient $C_L$, and integral control is carried out at the steps 427 et seq. In this connection, the predetermined leaning coefficient $C_L$ is set at a value smaller than 1.0.

If the answer to the question of the step 401 is negative (No), i.e. if feedback control was carried out in the immediately preceding loop it is determined at a step 402 whether or not the throttle valve opening $\theta_{TH}$ was larger than the idling throttle valve opening value $\theta_{IDL}$ in the immediately preceding loop. If the answer to this question is negative (No), it is further determined at a step 404 whether or not the throttle valve opening $\theta_{TH}$ is larger than the idling throttle valve opening value $\theta_{IDL}$ in the present loop. If the answer to this question is affirmative (Yes), it is determined at a step 405 whether or not the engine 1 was in the idling region in the immediatelY preceding loop. If the answer to this question is negative (No), i.e. if the engine 1 was in the off-idling region in the immediately preceding loop the program proceeds to the step 407, where the correction coefficient $K_{02}$ is set to a product $C_R \times K_{REF1}$ of the off-idling region average value $K_{REF1}$ and the predetermined enriching coefficient $C_R$, whereas if the answer is affirmative (Yes), i.e. if the engine 1 was in the idling region in the immediately preceding loop, the correction coefficeint $K_{02}$ is set at a step 406 to an average value $K_{REF2}$ of correction coefficient $K_{02}$ values applied when the engine 1 is accelerated under high load, which is calculated at a step 437 referred to hereinafter, followed by the program proceeding to the step 427.

If the answer to the question of the step 402 is affirmative (Yes), i.e. if $\theta_{TH} > \theta_{IDL}$ in the immediately preceding loop, or if the answer to the question of the step 404 is negative (No), i.e. if $\theta_{TH} \leqq \theta_{IDL}$ in the present loop, it is determined at a step 403 whether or not there has been an inversion in the output level of the $O_2$ sensor 15. If the answer to this question is negative (No), integral control is carried out at the steps 427 et seq.

If the answer to the question of the step 403 is affirmative (Yes), i.e. if there has been an inversion in the output level of the $O_2$ sensor 15, proportional control (P-term control) is carried out. First, at a step 417, it is determined whether or not the output voltage $V_{02}$ of the $O_2$ sensor 15 is lower than a reference voltage $V_{REF}$.

Figure 5:
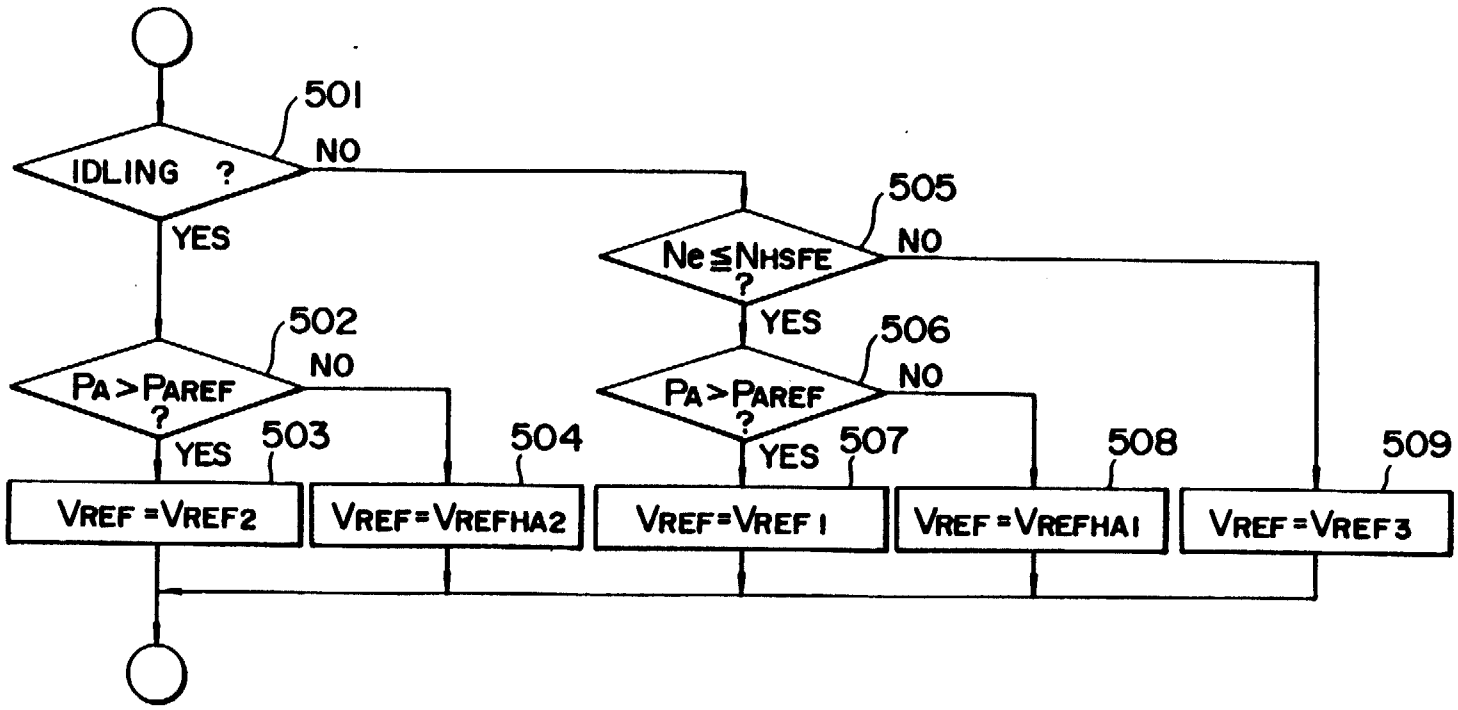
FIG. 5 is a flowchart of a subroutine for setting a reference voltage value ($V_{REF}$)

FIG. 5 shows a subroutine for setting this reference voltage $V_{REF}$. At a step 501, it is determined whether or not the engine 1 is in the idling region. If the answer to this question is negative (No}, i.e. if the engine 1 is in the off-idling region, it is determined at a step 505 whether or not the engine rotational speed Ne is not higher than a predetermined reference value $N_{HSFE}$ (e.g. 3,900 rpm).

If the answer to the question of the step 501 is affirmative (Yes), or if the answer to the question of the step 501 is negative (No) and at the same time the answer to the question of the step 505 is affirmative, i.e. if the engine 1 is in the idling region, or if the engine 1 is in the off-idling region and at the same time $Ne \leqq N_{HSFE}$, in both oases, it is determined at respective steps 502 and 506 whether or not atmospheric pressure $P_A$ is higher than a predetermined value $P_{AREF}$ (e.g. 670 mmHg). If the answers to the questions of the steps 502 and 506 are affirmative (Yes), i.e. if $P_A > P_{AREF}$, the reference voltage $V_{REF}$ is set at steps 503 and 507 to respective normal (sea level) reference values $V_{REF2}$ and $V_{REF1}$. On the other hand, if the answers to the questions of the steps 502 and 506 are negative (No), i.e. if $P_A \leqq P_{AREF}$, the reference voltage $V_{REF}$ is set at steps 504 and 508 to respective high altitude reference values $V_{REFHA2}$ and $V_{REFHA1}$ higher than the normal reference values.

If both the answers to the questions of the steps 501 and 505 are negative (No), i.e. if the engine 1 is in the off-idling region and at the same time $Ne > N_{HSFE}$, the reference voltage $V_{REF}$ is set at a step 509 to a high-engine-rotational-speed reference value $V_{REF3}$ (e.g. 0.575 V) higher than the normal reference value $V_{REF1}$.

As described above, by setting the reference voltage $V_{REF}$ to the higher value when the engine 1 is in a high rotational speed region, it is possible to shift the desired air-fuel ratio to a richer value while feedback control is carried out in this region.

Referring again to FIG. 4, if the answer to the question of the step 417 is affirmative (Yes), i.e. if $V_{02} < V_{REF}$ which means that the air-fuel ratio has changed from a rich side to a lean side, it is determined at a step 418 whether or not a predetermined time period $t_{PR}$ has elapsed after a second proportional term $P_R$, referred to hereinafter was applied on the last occasion. This predetermined time period $t_{PR}$ is provided in order to apply the second proportional term $P_R$ at a constant frequency over the whole engine rotational speed range. Therefore, the predetermined time period $t_{PR}$ is set to a smaller value as the engine rotational speed Ne is higher. If the answer to the question of the step 418 is affirmative (Yes), the second proportional term $P_R$ is determined at a step 419 based on the engine rotational speed Ne and the intake pipe absolute pressure $P_{BA}$ by a subroutine shown in FIG. 6, whereas if the answer is negative (No), a first proportional term P is determined based on the engine rotational speed Ne at a step 424 by an Ne -P table shown in FIG. 7*a*.

Figure 6:
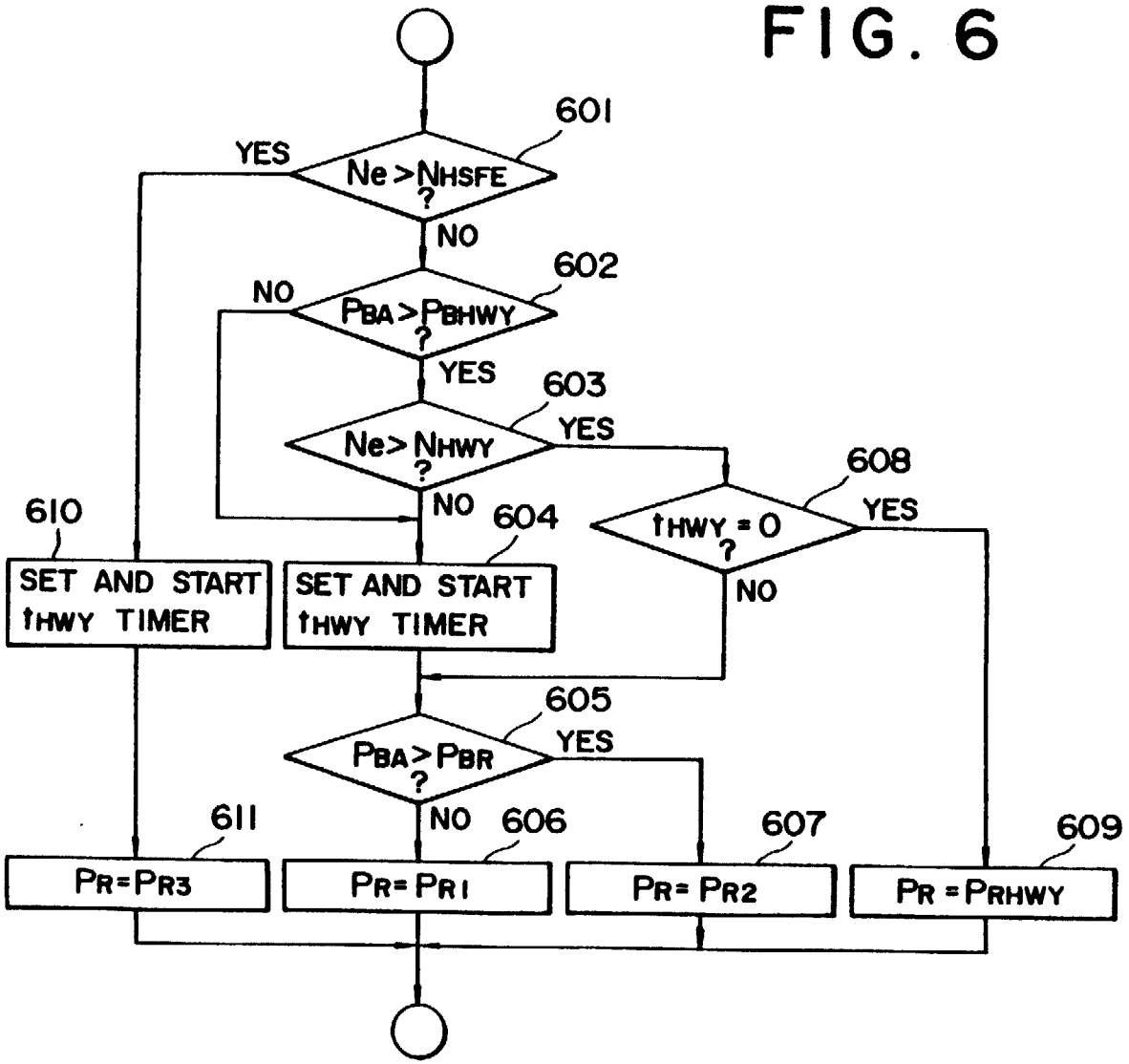
FIG. 6 is a flowchart of a subroutine for setting a second proportional term ($P_R$)

At a step 601 in FIG. 6, it is determined whether or not the engine rotational speed Ne is higher than the aforementioned predetermined reference value $N_{HSFE}$. If the answer to this question is negative (No), i.e. if $Ne \leqq N_{HSFE}$, it is determined at a step 602 whether or not the intake pipe absolute pressure $P_{BA}$ is higher than a first predetermined value $P_{BHWY}$ (e.g. 310 mmHg). If the answer to this question is affirmative (Yes), i.e. if $P_{BA} > P_{BHWY}$, it is determined ar a step 603 whether or not the engine rotational speed Ne is higher than a predetermined value $N_{HWY}$ (e.g 2,400 rpm) lower than the predetermined reference value $N_{HSFE}$. If the answer to the question of the step 602 is negative {No), or if the answer to the question of the step 602 is affirmative (Yes) and at the same time the answer to the question of the step 603 is negative, i.e. if $P_{BA} \leqq P_{BHWY}$, or if $P_{BA} > P_{BHWY}$ and at the same time $Ne \leqq N_{HWY}$, a $t_{HWY}$ timer is set to a predetermined time period $t_{HWY}$ (e.g 10 seconds) and started at a step 604, and then the program proceeds to a step 605. At the step 605, it is determined whether or not the intake pipe absolute pressure $P_{BA}$ is higher than a second predetermined value $P_{BR}$ (e.g. 410 mmHg) higher than the first predetermined value $P_{BHWY}$. If the answer to this question is negative (No), i.e. if $P_{BA} \leqq P_{BR}$, the second proportional term $P_R$ is set to a first value $P_{R1}$ at a step 606 whereas if the answer is affirmative (Yes), i.e. if $P_{BA} > P_{BR}$, the second proportional term $P_R$ is set to a second value $P_{R2}$ at a step 607.

If the answer to the question of the step 601 is affirmative (Yes), i.e if $Ne > N_{HSFE}$, the $t_{HWY}$ timer is set to the predetermined time period $t_{HWY}$ and started at a step 610, in the same manner as the step 604, and the second proportional term $P_R$ is set to a third value $P_{R3}$ (e.g. 0.5) at a step 611.

If the answer to the question of the step 601 is negative (No), and at the same time both the answers to the questions of the steps 602 and 603 are affirmative (Yes), i.e. if $N_{HWY} < Ne \leqq N_{HSFE}$ and at the same time $P_{BA} > P_{BHWY}$, which means that the engine is in the operating condition of high load and high rotational speed, it is determined at a step 608 whether or not the count value of the $t_{HWY}$ timer started at the step 604 or 610 is equal to 0. If the answer to this question is negative (No}, i.e. the engine operating condition of high load and high rotational speed has not continued over the predetermined time period $t_{HWY}$, the program proceeds to the step 605, whereas if the answer is affirmative (Yes), i.e. the above engine operating condition has continued over the predetermined time period $t_{HWY}$, the second proportional term $P_R$ is set at a step 609 to a fourth value $P_{RHWY}$ (e.g. 0.8) larger than the first to third values $P_{R1}$ to $P_{R3}$.

Figure 7A:
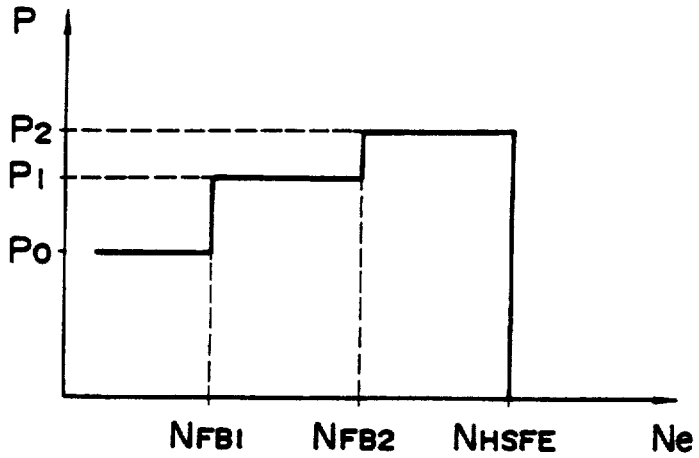
FIG. 7*a* is a table of a first proportional term (P) set in accordance with the engine rotational speed (Ne)

On the other hand, the first proportional term P is set based on the engine rotational speed Ne, as shown in FIG. 7a. More specifically the first proportional term P is set to $P_0$ when $Ne \leqq N_{FB1}$, to $P_1$ when $N_{FB1} < Ne \leqq N_{FB2}$, to $P_2$ when $N_{FB2} < Ne \leqq N_{HSFE}$, and to 0 when $Ne > N_{HSFE}$.

Referring again to FIG. 4, at a step 420, the proportional term $P_i$ obtained at the step 419 or 424, i.e. the first proportional term P or the second proportional term $P_R$, is added to the correction coefficient $K_{02}$ applied in the immediately preceding loop. Thus, if there has been an inversion in the output level of the $0_2$ sensor 15 and the output voltage $V_{02}$ after the inversion is lower than the reference voltage $V_{REF}$, it is judged that the air-fuel mixture has changed from a rich state to a lean state, and the proportional term P or $P_R$ based on the engine rotational speed is added to the correction coefficient $K_{02}$ to thereby control the air-fuel ratio such that it becomes richer.

On the other hand if the answer to the question of the step 417 is negative (No), i.e. if $V_{02} \geqq V_{REF}$, the first proportional term P based on the engine rotational speed Ne is determined at a step 425 from the Ne - p table, similarly to the step 424 and the proportional term P is subtracted at a step 426 from the correction coefficient $K_{02}$ applied in the immediately preceding loop. In other words, if there has been an inversion in the output level of the $O_2$ sensor 15, and the output voltage $V_{02}$ after the inversion is higher than reference voltage $V_{REF}$, it is judged that the air-fuel mixture has changed from a lean state to a rich state, the first proportional term P is subtracted from the correction ooefficient $K_{02}$ to thereby control the air-fuel ratio such that it becomes leaner.

As is clear from FIG. 7a, when the engine rotational speed Ne is in a high engine rotational speed region higher than the predetermined reference value $N_{HSFE}$, the first proportional term P is set to 0, so that, actually, the subtraction of the first proportional term P from the correction coefficient $K_{02}$ is inhibited.

In addition, the first proportional term P may be set to 0 when the engine 1 is in a predetermined high load condition. In this case, when the engine is in the predetermined high load condition, the Sutraction of the first proportional term P from the correction coefficient $K_{02}$ is inhibited.

Referring again to FIG. 4, at a step 421, limitchecking of the correction coefficient $K_{02}$ set at the step 420 or 426 is carried out. More specifically, it is determined whether or not the value of the correction coefficient $K_{02}$ is within a predetermined range. If the value is not within the predetermined range, the correction coefficient $K_{02}$ is held at the upper or lower limit value defining the predetermined range.

Then, by the use of the value of the correction coefficient $K_{02}$ thus obtained, the idling region average value $K_{REFO}$ or the off-idling region average value $K_{REF1}$ is calculated at a step 420. More specifically, when the operating condition of the engine 1 is in the idling region, the idling region average value $K_{REFO}$ is calculated, whereas when the engine I is in the off-idling region, the off-idling region average value $K_{REF1}$ is calculated, by the following equation (2):

$$K_{REFn} = K_{02P} \times (C_{REFn}/A_n) + K_{REFn'} \times (A_n - C_{REFn})/A_n \ldots \quad (2)$$

where $K_{02P}$ is a value of $K_{02}$ obtained immediately after operation of proportional control or P-term control, $A_n$ a constant, $C_{REFn}$ a variable experimentally set for each feedback control region and having a suitable value ranging from 1 to A, and $K_{REFn'}$ an average value of $K_{02}$ obtained up to the immediately preceding loop in a feedback control region to which the present loop belongs.

Referring again to FIG. 4, the integral control carried out at the steps 427 et seq. will be explained. First, it is determined at a step 427 whether the output voltage $V_{02}$ of the $O_2$ sensor 15 is lower than the reference voltage $V_{REF}$. If the answer to this question is affirmative (Yes), i.e. if $V_{02} < V_{REF}$, a value of 1 is added to a count value $N_{IL}$ at a step 428 whenever this step is carried out, and it is determined at a step 429 whether or not the count value $N_{IL}$ has reached a predetermined value $N_I$. If the answer to this question is negative (No), the correction coefficient $K_{02}$ is held at a value obtained in the immediately preceding loop at a step 432, whereas if the answer is affirmative (Yes), an enriching integral term $\Delta K_R$ is added at a step 430 to the correction coefficient $K_{02}$ applied in the immediately preceding loop, and at the same time the count value $N_{IL}$ is reset to 0 at a step 431. Thus, the enriching integral term $\Delta K_R$ is added to the correction coefficient $K_{02}$ whenever the count value $N_{IL}$ reaches the predetermined value $N_I$.

Thus, so long as the output voltage $V_{02}$ of the $O_2$ sensor 15 continues to be lower than the reference voltage $V_{REF}$, i.e. while the air-fuel ratio continues to be lean, the correction coefficient $K_{02}$ is increased by an increment of the enriching integral term $\Delta K_R$ whenever the count value $N_{IL}$ reaches the predetermined value $N_I$, to thereby control the air-fuel ratio such that it becomes richer.

Figure 7B:
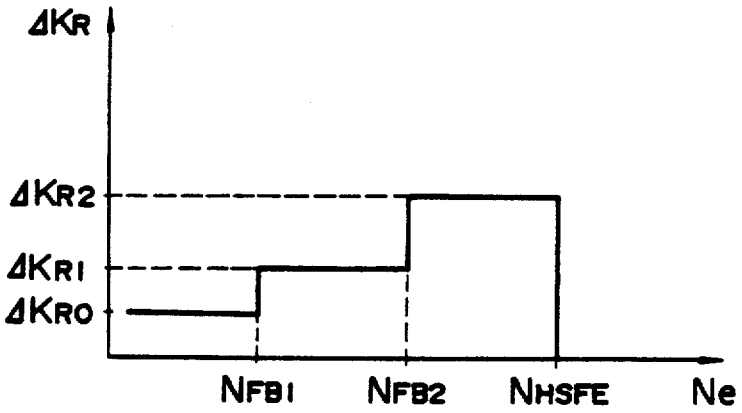
FIG. 7*b* is a table of an integral term ($\Delta K_R$) set in accordance with the engine rotational speed (Ne)

The enriching integral term $\Delta K_R$ is set based on the engine rotational speed Ne, as shown in FIG. 7b. More specifically the enriching integral term $\Delta K_R$ is set to $\Delta K_{RO}$ when $Ne \leqq N_{FB1}$, to $\Delta K_{R1}$ when $NFB1 < Ne \leqq N_{FB2}$, to $\Delta K_{R2}$ when $N_{FB2} < Ne \leqq N_{HSFE}$, and to 0 when $Ne > N_{HSFE}$. Therefore, when the engine rotational speed Ne is in a high engine rotational speed region higher than the predetermined reference value $N_{HSFE}$, the addition of the enriching integral term $\Delta K_R$ to the correction coefficient $K_{02}$ is inhibited.

On the other hand, if the answer to the question of the step 427 is negative (No), i.e. if $V_{02} \leqq V_{REF}$, a value of 1 is added to a count value $N_{IH}$ at a step 433 whenever this step is carried out, and it is determined at a step 434 whether or not the count value $N_{IH}$ has reached the predetermined value NI. If the answer to this question is negative (No), the aforementioned step 432 is carried out to hold the correction coefficient $K_{02}$ at a value obtained in the immediately preceding loop, whereas if the answer is affirmative (Yes), a leaning integral term $\Delta K_L$ is subtracted at a step 435 from the correction coefficient $K_{02}$ applied in the immediately preceding loop, and at the same time the count value $N_{IH}$ is reset to 0 at a step 436. Thus, the leaning integral term $\Delta K_L$ is subtracted from the correction coefficient $K_{O2}$ whenever the count value $N_{IH}$ reaches the predetermined value $N_I$.

Thus, so long as the output voltage $V_{02}$ of the $O_2$ sensor 15 continues to be not lower than the reference voltage $V_{REF}$, i.e. while the air-fuel ratio continues to be rich, the correction coefficient $K_{02}$ is decreased by a decrement of the leaning integral term $\Delta K_L$ whenever the count value $N_{IH}$ reaches the predetermined value $N_I$, to thereby control the air-fuel ratio such that it becomes leaner.

Figure 7C:
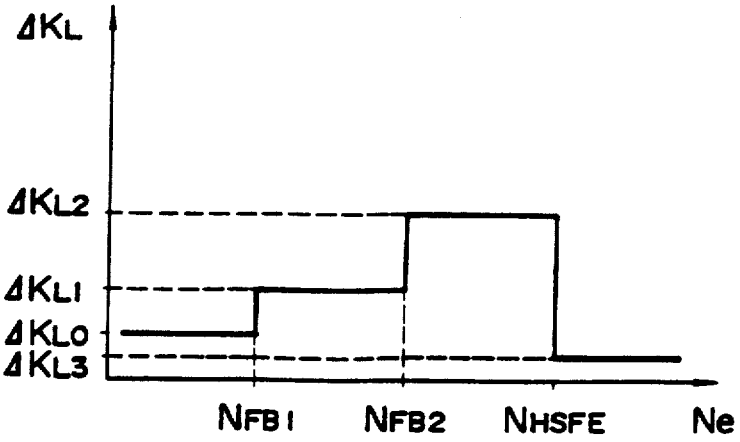
FIG. 7*c* is a table of an integral term ($\Delta K_L$) set in accordance with the engine rotational speed (Ne)

The leaning integral term $\Delta K_L$ is set based on the engine rotational speed Ne, as shown in FIG. 7c. More specifically, the leaning integral term $\Delta K_L$ is set to $\Delta K_{LO}$ when $Ne \leqq N_{FB1}$, to $\Delta K_{L1}$ when $NFB1 < Ne \leqq N_{FB2}$, to $\Delta K_{L2}$ when $N_{FB2} < Ne \leqq N_{HSFE}$, and to $K_{L3}$ when $Ne > N_{HSFE}$.

Referring again to FIG. 4, at the step 437, the average value $K_{REF2}$ to be applied at the step 406 when the engine I is accelerated under high load is calculated by the following equation (3), followed by terminating the present subroutine:

$$K_{REF2} = K_{02PL} \times (C_{REF2}/A_2) + K_{REF1'} \times (A_2 - C_{REF2})/A_2 \ldots \quad (3)$$

where $K_{02PL}$ is a value of $K_{02}$ obtained immediately before the subtraction of the first proportional term P (step 426) after detection of a predetermined high 10 load accelerating condition of the engine 1, $A_2$ a constant, $C_{REF2}$ a variable having a suitable value ranging from 1 to $A_2$, and $K_{REF1'}$ an average value of $K_{02}$ obtained up to the immediately preceding loop in the off-idling region.

Figure 8A:
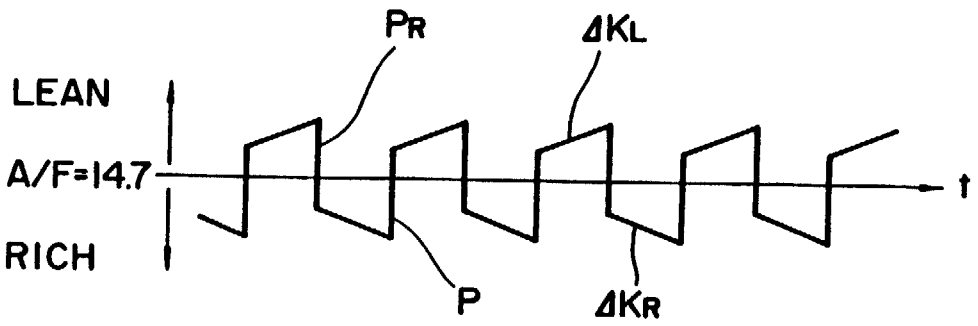
FIGS. 8*a* and 8*b* are diagrams useful in explaining changes in the air-fuel ratio with lapse of time during the air-fuel ratio feedback control.
Figure 8B:
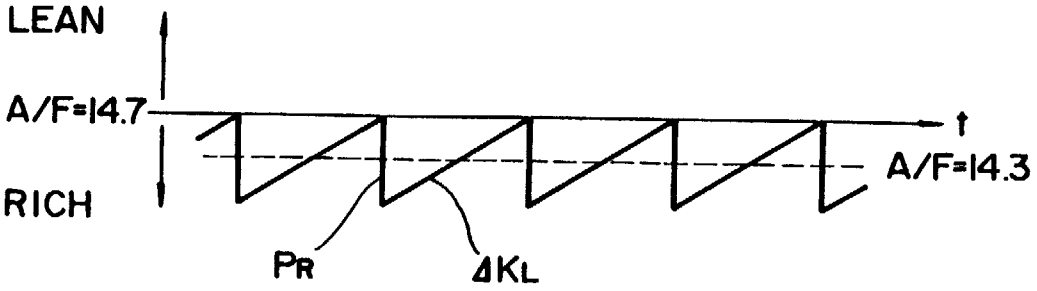

FIGS. 8a and 8b show, by way of example, changes in the air-fuel ratio with the lapse of time which take place when the air-fuel ratio feedback control is carried out by setting the correction coefficient $K_{02}$ in the manner shown in FIG. 4. FIG. 8a shows a case in which the engine rotational speed Ne is not in the high engine rotational speed region ($Ne \leqq N_{HSFE}$), and FIG. 8b shows a case in which the engine rotational speed Ne is in the high engine rotational speed region ($Ne > N_{HSFE}$). As is clear from the figures, when $Ne \leqq N_{HSFE}$, the average air-fuel ratio is controlled to a so-called stoichiometric ratio (=14.7), whereas when $Ne > N_{HSFE}$, the average air-fuel ratio is shifted toward a richer side, e.g. to a value of 14.3.

As stated before the setting of the first proportional term P to O is not limited to the case where the engine rotational speed Ne is in the high engine rotational speed region, but may be also carried out when the engine 1 is in a predetermined high load region. In this case, the air-fuel ratio is shifted to a richer side when the engine 1 is in the predetermined high load region.

As a result, it is possible to largely reduce the degree of deterioration of the three-way catalyst 14 occurring when the engine 1 is at high rotational speed or under high load. Further, since the second proportional term $P_R$ is not set to an excessively large value (see FIG. 6, the step 611). even if the second proportional term $P_R$ is added to the correction ooefficient $K_{02}$ when the output voltage $V_{02}$ of the $O_2$ sensor changes from a state in which it is higher than the reference voltage $V_{REF}$ (i.e. the air-fuel ratio is rich) to a state in which it is lower than same (i.e. the air-fuel ratio is lean), it is possible to prevent a great change in the engine output torque, i.e. degradation in the driveability.

What is claimed is:

1. In a method of controlling the air-fuel ratio of a mixture supplied to an internal combustion engine in a feedback manner responsive to an output signal from an exhaust gas concentration sensor for detecting the concentration of a component in exhaust gases from said engine, the method including the steps of:

comparing the value of said output signal with a predetermined reference value; and controlling the air-fuel ratio of said mixture to a desired value by means of proportional control applying a first correction value to correct the air-fuel ratio when the value of said output signal has changed from a rich side to a lean side or vice versa with respect to said predetermined reference value, and integral control applying a second correction value to correct the air-fuel ratio whenever a predetermined period of time elapses so long as the value of said output signal remains on the lean side or on the rich side with respect to said predetermined reference value;

the improvement comprising the step of:

inhibiting said correction by said first correction value, when the value of said output signal has changed from the lean side to the rich side with respect to said predetermined reference value while said engine is operating in one of a predetermined high load condition and a predetermined high rotational speed condition.

2. A method according to claim 1, wherein said first correction value is set to a relatively small value as compared with when said engine is not operating in said predetermined high rotational speed condition, when the value of said output signal has changed from the rich side to the lean side with respect to said predetermined reference value while said engine is operating in said predetermined high rotational speed condition.

3. A method according to claim 1 or 2, wherein said second correction value is set to a smaller value when said engine is operating in said predetermined high rotational speed condition than when the condition of said engine is not operating in said predetermined high rotational speed condition.

4. A method according to claim 1 or 2, wherein said first correction value is increased as the rotational speed of said engine increases, when the value of said output signal has changed from the lean side to the rich side with respect to said predetermined reference value while said engine is not operating in said predetermined high rotational speed condition.

5. A method according to claim 1 or 2, wherein said second correction value is increased as the rotational speed of said engine increases, when said engine is not operating in said predetermined high rotational speed condition.

6. A method according to claim 1 or 2, wherein said first correction value is set based on the rotational speed of said engine and the intake pipe absolute pressure of said engine, when the value of said output signal has changed from the rich side to the lean side with respect to said predetermined reference value while said engine is not operating in said predetermined high rotational speed condition.

7. A method according to claim 1 or 2, wherein said predetermined reference value is set based on the rotational speed of said engine and atmosperic pressure.

* * * * *